US007661991B1

(12) United States Patent
Sun

(10) Patent No.: US 7,661,991 B1
(45) Date of Patent: Feb. 16, 2010

(54) ELECTRICAL CONNECTOR

(75) Inventor: Dao-Rui Sun, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/222,823

(22) Filed: Aug. 18, 2008

(51) Int. Cl.
*H01R 13/648* (2006.01)

(52) U.S. Cl. ..... 439/607.55

(58) Field of Classification Search ..... 439/607.17, 439/607.19, 607.35, 607.55
See application file for complete search history.

(56) References Cited

U.S. PATENT DOCUMENTS 4,894,026 A * 1/1990 Dixon et al. ..... 439/607.17
5,908,331 A * 6/1999 Hsu et al. ..... 439/607.28

* cited by examiner

*Primary Examiner*—Ross N Gushi
(74) *Attorney, Agent, or Firm*—Rosenberg, Klein & Lee

(57) ABSTRACT

An electrical connector mating with a mating connector has an insulating housing. The insulating housing defines a ring-shaped insertion recess in a front surface thereof and a mating portion surrounded by the insertion recess. The mating portion has a plurality of insertion holes passing through the insulating housing. A plurality of terminals is received in the insulating housing. The terminal defines a fixing plate. One end of the fixing plate extends frontward to form two spaced apart connection arms. A soldering portion extending from the other end of the fixing plate extends out of the insulating housing. The connection arms and the fixing plate are restricted in a rear of the insertion hole.

7 Claims, 5 Drawing Sheets

ELECTRICAL CONNECTOR

BACKGROUND OF THE INVENTION

1. Field of the Invention

The present invention relates to an electrical connector, and more particularly to an electrical connector mainly used for receiving separate video signal.

2. The Related Art

Separate video (S-Video) is a video-signal transmission, which is capable of respectively transmitting the luminance signal and the chrominance signal. Because the S-Video is needless to be encoded and decoded in the process of the signal transmission, the S-Video signal forming the image is better than the standard signal. Hence, the electrical connector with a receiving interface of the S-Video signal is widely used in many kinds of electrical devices, such as digital television, projector and digital video disc (DVD).

Conventionally, an electrical connector adapted for receiving the S-Video signal includes a plurality of terminals, an end of the terminal is designed to show a sleeve-shape for receiving a terminal of a mating connector. However, the terminal with the sleeve-shaped end is not convenient for the manufacture so as to increase the manufacture cost. Furthermore, such terminal assembled in an insulating housing of the electrical connector connects with the terminal of the mating connector unreliably so as to have influence on the signal transmission. As a result, the application range of the electrical connector is restrained because of the high manufacture cost and bad quality of signal transmission.

SUMMARY OF THE INVENTION

Accordingly, an object of the present invention is to provide an electrical connector having a terminal with a more reliable connection structure and lower manufacture cost.

The electrical connector mating with a mating connector has an insulating housing. The insulating housing defines a ring-shaped insertion recess in a front surface thereof and a mating portion surrounded by the insertion recess. The mating portion has a plurality of insertion holes passing through the insulating housing. A plurality of terminals is received in the insulating housing. The terminal defines a fixing plate. One end of the fixing plate extends frontward to form two spaced apart connection arms. A soldering portion extending from the other end of the fixing plate extends out of the insulating housing. The connection arms and the fixing plate are restricted in a rear of the insertion hole.

As described above, the terminal has the fixing plate and the connection arms extending from one end of the fixing plate. The fixing plate and the connection arms are easy to be manufactured and assembled, which can reduce the manufacture cost and time of the electrical connector. In additional, the connection arms spaced apart from each other are capable of clamping a terminal of a mating connector firmly, which addresses the problem that the terminal of the electrical connector poorly connects with the terminal of the mating connector.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE EMBODIMENTS

Figure 1:
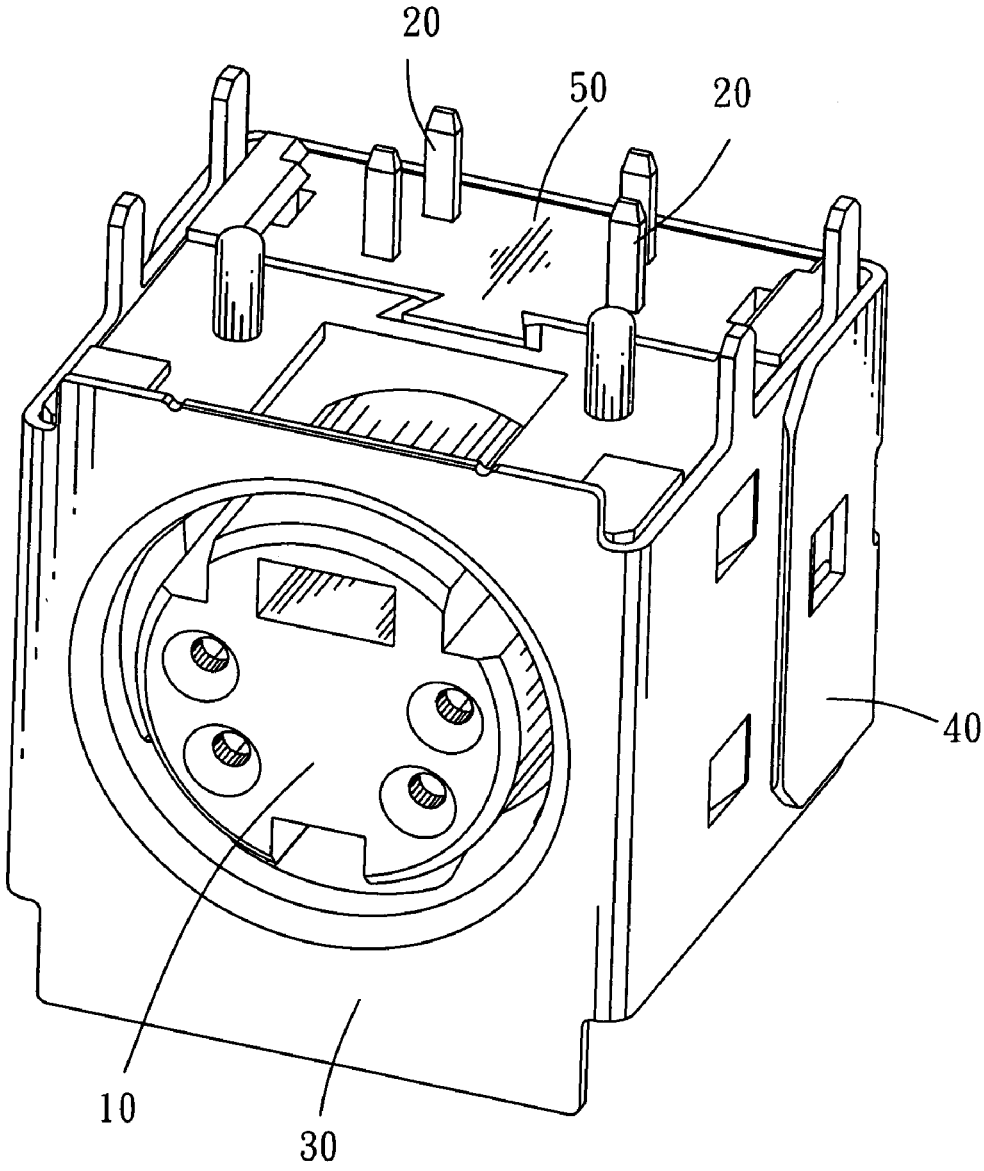
FIG. 1 is an assembled view of an electrical connector in an embodiment according to the present invention.

With reference to FIG. 1, an embodiment of an electrical connector used to receive S-video signal according to the present invention is shown. The electrical connector includes an insulating housing 10, a plurality of terminals 20, a first shell 30, a second shell 40 and a covering component 50.

Figure 2:
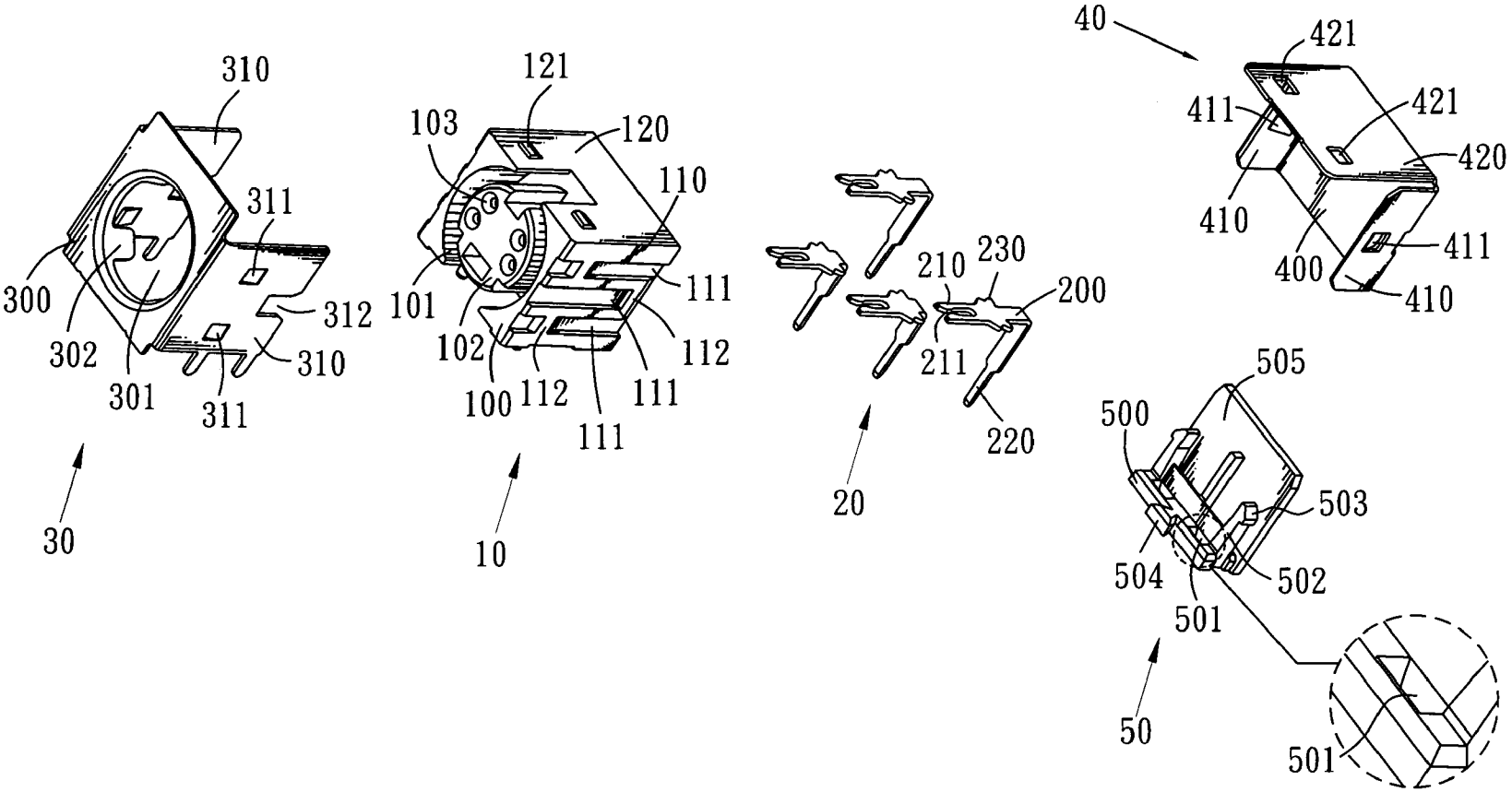
FIG. 2 is an exploded view of the electrical connector shown in FIG. 1.
Figure 3:
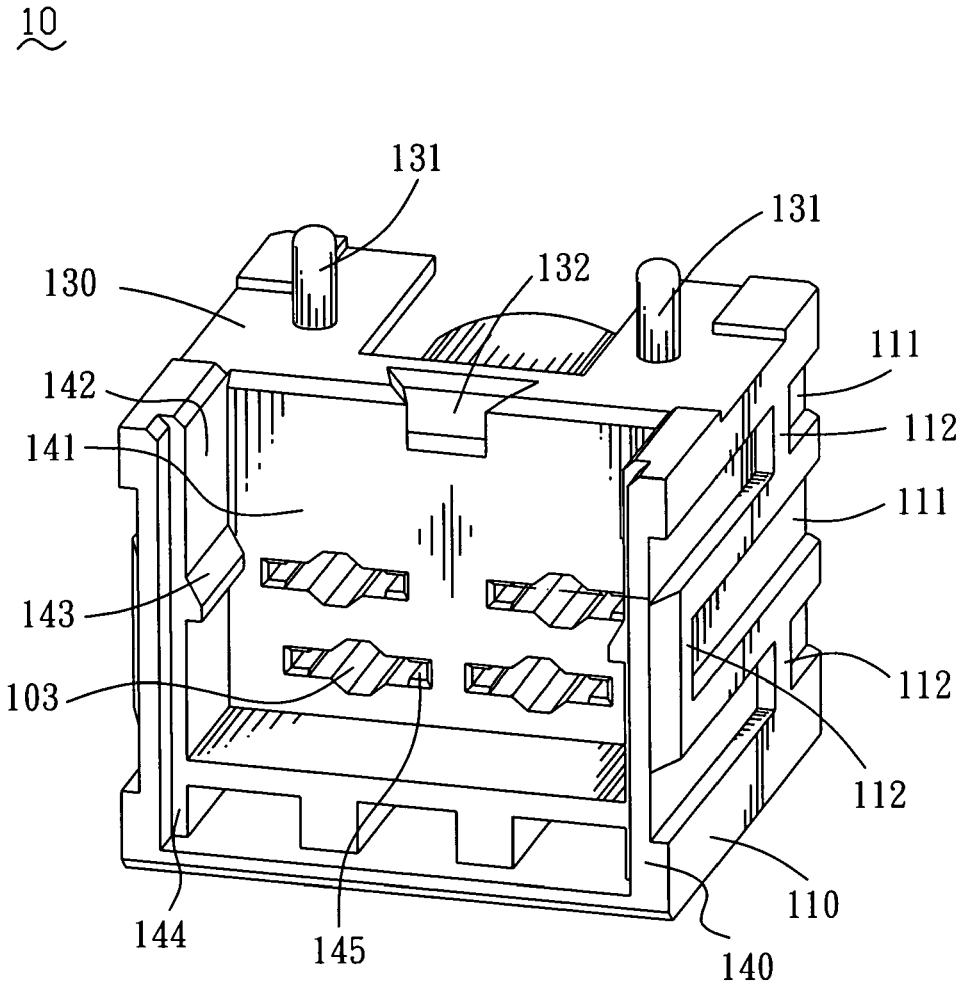
FIG. 3 is a perspective view of an insulating housing shown in FIG. 2 seen from another view.

Please refer to FIG. 2 and FIG. 3, the insulating housing 10 is a rectangular shape and defines a front surface 100, two side surfaces 110, a top surface 120, a bottom surface 130 and a rear surface 140. The front surface 100 is recessed inwards to form a ring-shaped insertion recess 101 and a mating portion 102 surrounded by the insertion recess 101. The mating portion 102 has four insertion holes 103 passing through the whole insulating housing 10. The side surface 110 has three slots 111 extending frontward and backward thereon. Each of the slots 111 defines a closed end 112 near an end thereof. The top surface 120 of the insulating housing 10 has two bumps 121 near the front surface 100.

The rear surface 140 has a receiving chamber 141. The receiving chamber 141 passes through the bottom surface 130 and communicates with all the insertion holes 103. A bottom of the receiving chamber 141 is recessed inwards to form two buckling recesses 145 arranged symmetrically near the insertion holes 103. The buckling recess 145 communicates with the insertion hole 103. The receiving chamber 141 defines two opposite sides 142. Each of the two opposite sides 142 has a stopping projection 143 arranged transversely at the middle thereof. The rear surface 140 defines a resistive portion 144 adjacent to each of the two opposite sides 142. The bottom surface 130 of the insulating housing 10 extends outwards to form two leading portions 131 for guiding the electrical connector to mate with a mating connector (not shown). A fixing recess 132 is formed in the bottom surface 130 and between the leading portions 131. The fixing recess 132 is a coattail shape, with a narrow end thereof communicating with the receiving chamber 141.

Figure 4:
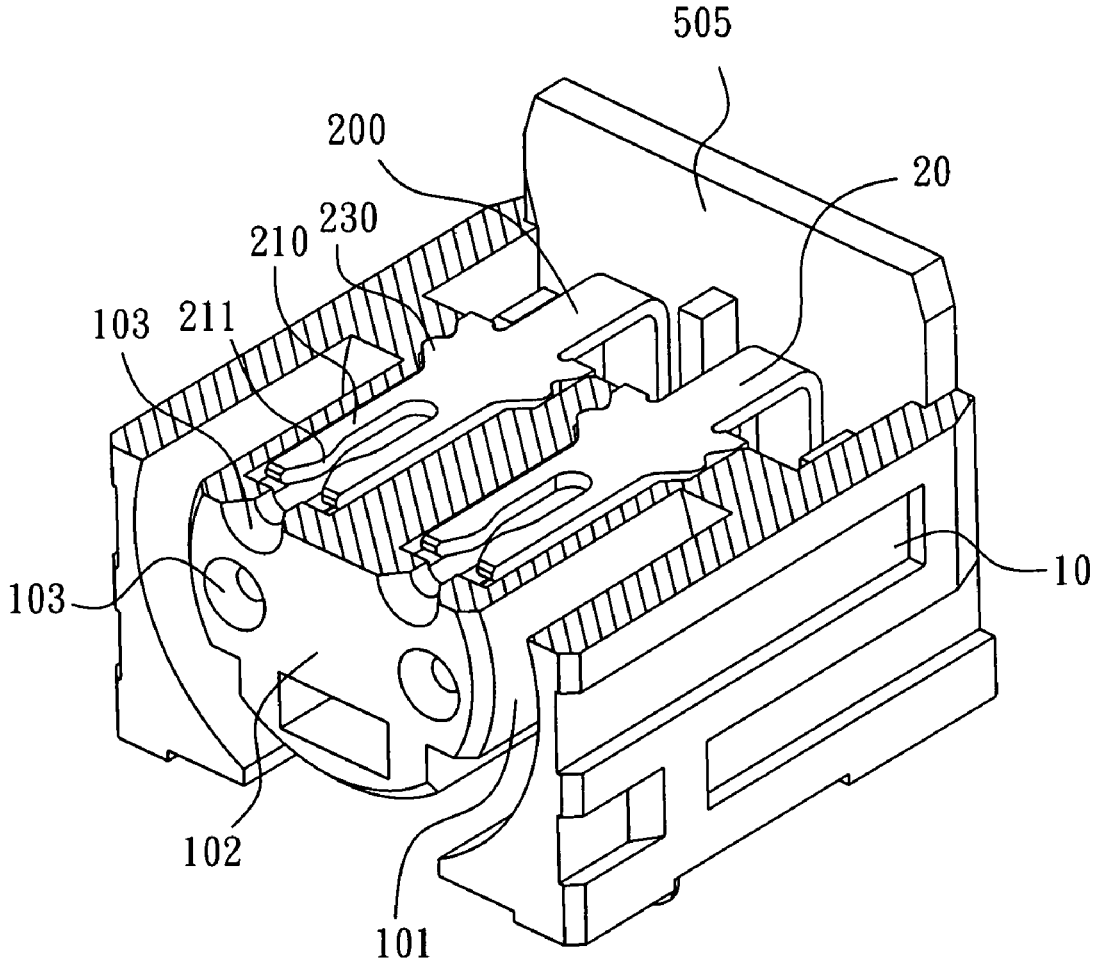
FIG. 4 is a cross-sectional view of the insulating housing shown in FIG. 3, wherein a terminal and a covering component are assembled therein.
Figure 5:
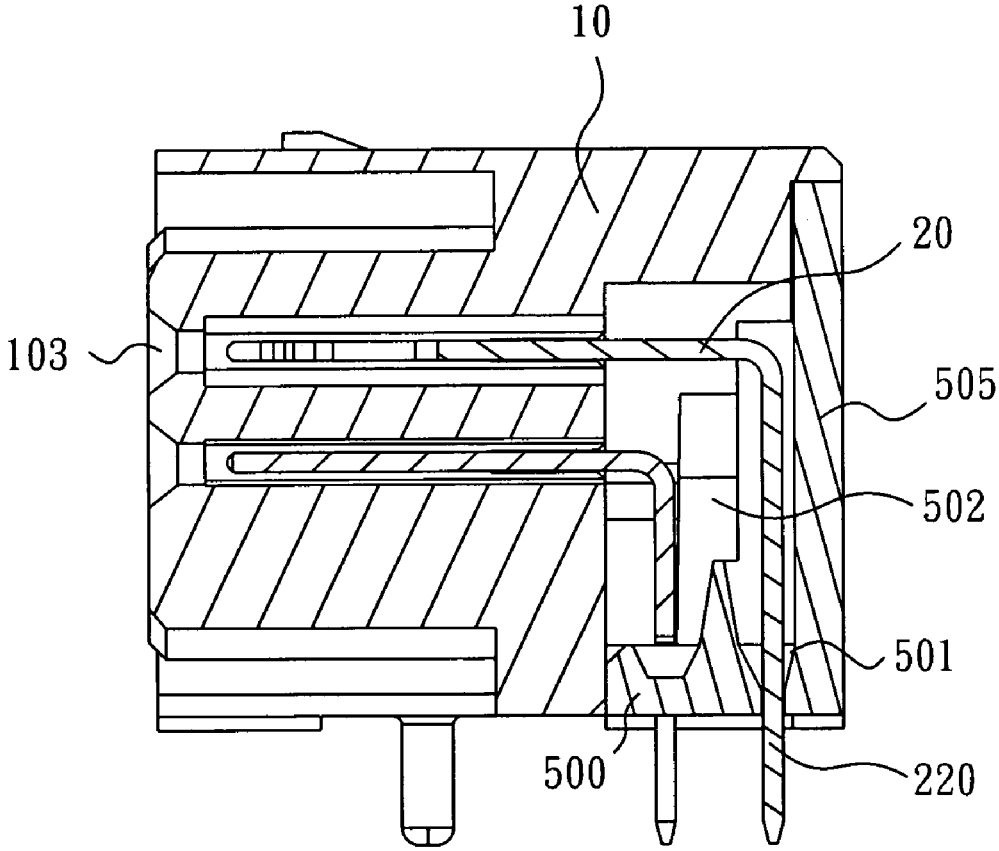
FIG. 5 is another cross-sectional view of the insulating housing shown in FIG. 3, wherein the terminal and the covering component are assembled therein.

Referring to FIG. 2 and FIGS. 4-5, the terminal 20 received in the insulating housing 10 defines a fixing plate 200. One end of the fixing plate 200 extends frontward to form two facing and spaced apart connection arms 210. Free ends of the two connection arms 210 protrude towards each other to form protrusions 211 for elastically clamping a terminal of the mating connector (not shown). The other end of the fixing plate 200 bends downwards to form a soldering portion 220. Two sides of the fixing plate 200 respectively extend outwards to a buckling portion 230 corresponding to the buckling recess 145. In assembly, the fixing plate 200 and connection arms 210 are inserted into the insertion hole 103 of the insulating housing 10 from the receiving chamber 141. The buckling portions 230 are respectively received in the corresponding buckling recesses 145 for fixing the terminal 20 into the insulating housing 10, and the soldering portion 220 is partly received in the receiving chamber 141. A free end of the soldering portion 220 extends out of the insulating housing 10 for being soldered on a printed circuit board (not shown).

Please refer to FIG. 1 and FIG. 2, the first shell 30 covering the insulating housing 10 defines a first basic plate 300 and two first side plates 310 bending from two opposite sides of the first basic plate 300. The first basic plate 300 has an opening 301 corresponding to the insertion recess 101. An edge of the opening 301 bends inwards to form a plurality of tabs 302. The tab 302 is received in the insertion recess 101 for being elastically against an insertion portion of the mating connector (not shown), which guarantees the electrical connector and the mating connector to connect with each other firmly. Each of the first side plates 310 is punched inwards to form two buckling pieces 311, and has a mating opening 312 formed in the middle of a bottom side thereof for avoiding affecting the second shell 40 to be assembled to the insulating housing 10. In assembly, the first basic plate 300 covers the front surface 100, with the tabs 302 extending into the insertion recess 101. The first side plates 310 respectively are mated with the side surfaces 110, with the buckling pieces 311 extending into the slots 111 and abutting the corresponding closed end 112 for fixing the first shell 30 to the insulating housing 10.

the second shell 40 defines a second basic plate 400, two second side plates 410 bending from two opposite sides of the second basic plate 400 and a casing plate 420 bending towards the second side plate 410 from an end of the second basic plate 400. The second side plate 410 is punched inwards to form a buckling piece 411 corresponding to the closed end 112. The casing plate 420 has two buckling holes 421 corresponding to the bumps 121. In assembly, the second basic plate 400 is covered the rear surface 140 of the insulating housing 10, and the second side plates 410 and the casing plate 420 are coupled with the side surfaces 110 and the top surface 120, respectively. The buckling piece 411 extends into the slot 111 of the side surface 110 and abuts the closed end 112, and the buckling holes 421 are respectively mated with the bumps 121 of the top surface 120 for fixing the second shell 40 to the insulating housing 10.

Please refer to FIG. 2 and FIG. 5, the covering component 50 defines a covering lid 500. The covering lid 500 is an oblong and has a plurality of through holes 501 for allowing the soldering portions 220 passing therethrough. Both ends of the covering lid 500 extend perpendicularly to form a connecting portion 502, respectively. Free ends of the connecting portions 502 protrude opposite to each other to form a stopping portion 503, respectively. The stopping portion 503 is adapted to abut the stopping projection 143 for fixing the covering component 50. One side of the covering lid 500 extends outwards to form a fixing portion 504 corresponding to the fixing recess 132. The other side of the covering lid 500 extends perpendicularly to form a covering plate 505 adapted to seal the receiving chamber 141.

Please refer to FIGS. 1-3 and FIG. 5, in assembly, the terminal 20 is inserted into the insertion hole 103 from the receiving chamber 141. The covering component 50 is moved upwardly from the bottom surface 130 with the covering plate 505 sliding along the resistive portion 144 until the stopping portions 503 buckle the stopping projections 143, and the fixing portion 504 mates with the fixing recess 132. Thus the covering component 50 is fixed to the insulating housing 10, and the covering lid 500 is positioned in a bottom of the receiving chamber 141. The through hole 501 can restrict the soldering portion 220 for steadying the terminal 20. The first shell 30 is fixed to the insulating housing 10 from the front surface 100, and the second shell 40 is fixed to the insulating housing 10 from the rear surface 140. It should be noted that the method of assembling the electrical connector can be changed for conforming to different demands and should not be limited.

As described above, the terminal 20 has the fixing plate 200 and the connection arms 210 extending from an end of the fixing plate 200. The fixing plate 200 and the connection arms 210 are easy to be manufactured and assembled, which can reduce the manufacture cost and time. Furthermore, the protrusions 211 of the two facing and spaced apart connection arms 210 are capable of clamping the terminal of the mating connector firmly, which addresses the problem that the terminal 20 of the electrical connector poorly connects with the terminal of the mating connector. In additional, the first shell 30 and the second shell 40 are fixed to the insulating housing 10 via a simple structure, which further reduces the assembling time and cost.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector mating with a mating connector, comprising:

an insulating housing defining a ring-shaped insertion recess in a front surface thereof and a mating portion surrounded by the insertion recess, the mating portion having a plurality of insertion holes passing through the insulating housing, a rear surface of the insulating housing defining a receiving chamber communicating with the insertion holes and passing through a bottom surface of the insulating housing;

a plurality of terminals received in the insulating housing, each terminal having a fixing plate, one end of the fixing plate extends frontward to form two spaced apart connection arms, a soldering portion extends from the other end of the fixing plate and extends out of the insulating housing, the connection arms and the fixing plate being restricted in a rear of the insertion hole, the soldering portion of the terminal being partly received in the receiving chamber; and a covering component, the covering component having a covering plate positioned in a rear of the receiving chamber, a covering lid extending from one side of the covering plate and positioned in a bottom of the receiving chamber, the covering lid having a plurality of through holes for allowing the soldering portions to pass therethrough, one side of the covering lid opposite to the covering plate extends outwards to form a fixing portion, the bottom surface of the insulating housing having a fixing recess corresponding to the fixing portion and communicating with the receiving chamber, the fixing portion couples with the fixing recess for fixing the covering component to the insulating housing.

2. The electrical connector as claimed in claim 1, wherein free ends of the two connection arms of the terminal protrude towards each other to form protrusions for elastically clamping a terminal of the mating connector.

3. The electrical connector as claimed in claim 1, wherein one side of the fixing plate extends outwards to form a buckling portion, the insertion hole has a buckling recess at a side thereof corresponding to the buckling portion for fixing the terminal in the insertion hole.

4. The electrical connector as claimed in claim 1, further comprising a first shell covering the insulating housing and having an opening matching periphery of the insertion recess.

5. The electrical connector as claimed in claim 4, wherein the opening has a plurality of tabs bending inwards from an edge thereof to be inserted into the insertion recess.

6. The electrical connector as claimed in claim 4, wherein the first shell defines a first side plate with a buckling piece punched inwards thereon, the insulating housing defines a side surface having a slot with a closed end, the buckling piece extends into the slot and abuts against the closed end of the slot.

7. An electrical connector mating with a mating connector, comprising:

an insulating housing defining a ring-shaped insertion recess in a front surface thereof and a mating portion surrounded by the insertion recess, the mating portion having a plurality of insertion holes passing through the insulating housing, a rear surface of the insulating housing defining a receiving chamber communicating with the insertion holes and passing through a bottom surface of the insulating housing;

a plurality of terminals received in the insulating housing, each terminal having a fixing plate, one end of the fixing plate extends frontward to form two spaced apart connection arms, a soldering portion extends from the other end of the fixing plate and extends out of the insulating housing, the connection arms and the fixing plate being restricted in a rear of the insertion hole, the soldering portion of the terminal being partly received in the receiving chamber; and a covering component, the covering component having a covering plate positioned in a rear of the receiving chamber, a covering lid extending from one side of the covering plate and positioned in a bottom of the receiving chamber, the covering lid having a plurality of through holes for allowing the soldering portions to pass therethrough, two opposite sides of the covering lid extend along the covering plate to form two connecting portions, two free ends of the connecting portions protrude opposite to each other to form two stopping portions, two sides of the receiving chamber protrude towards each other to form two stopping projections for holding the stopping portions.

* * * * *